United States Patent [19]

Johnston

[11] Patent Number: 4,717,188

[45] Date of Patent: Jan. 5, 1988

[54] COIL PROTECTOR FOR "C" HOOKS

[75] Inventor: Richard H. Johnston, Natrona Heights, Pa.

[73] Assignee: Allegheny Ludlum Corporation, Pittsburgh, Pa.

[21] Appl. No.: 947,000

[22] Filed: Dec. 29, 1986

[51] Int. Cl.[4] ..... B66C 1/54

[52] U.S. Cl. ..... 294/67.2; 294/103.2

[58] Field of Search ..... 294/67.2, 103.2, 86.4, 294/119.3, 88, 104, 106, 98.1, 92, 119.2, 86.32, 87.12, 99.1; 414/621, 729, 741, 742, 910

[56] References Cited

U.S. PATENT DOCUMENTS 2,675,261 4/1954 Egge ..... 294/103.2

3,291,519 12/1966 Burke ..... 294/67.2

*Primary Examiner*—James B. Marbert

*Attorney, Agent, or Firm*—Patrick J. Viccaro

[57] ABSTRACT

A protective attachment for the vertical leg of a "C" hook for lifting steel coils. The protective attachment surrounds the forward portion of the aforesaid vertical leg and is covered with shock-absorbing material to prevent damage to the edges of the steel coil as the hook is being inserted into the central opening of the coil prior to its being lifted by an overhead crane.

5 Claims, 2 Drawing Figures

COIL PROTECTOR FOR "C" HOOKS

BACKGROUND OF THE INVENTION

In the steel industry, a so-called "C" hook is used to lift and transport steel coils. The hook is usually made from steel plate and, as the name implies, is generally C-shaped in configuration, having a vertical portion with upper and lower horizontal legs projecting therefrom. The horizontal upper leg has a clevis attached to the "C" hook at its approximate center or balance point such that a crane hook may be inserted into the clevis for lifting. The bottom leg of the hook is inserted into the central opening of a steel coil such that when the hook is lifted by a crane, it will carry with it the coil which rests on the lower leg.

As can be understood, the lower leg of the "C" hook is inserted into the central opening of coil while suspended from an overhead crane. The hook is typically formed from about three inch steel plate and, consequently, is quite heavy. It often happens that the vertical portion of the hook slams against the side of the coil while the vertical leg is being introduced into the central opening of the coil. This can cause damage to the edges of the strip material, even though the edges might be perfectly aligned.

SUMMARY OF THE INVENTION

In accordance with the present invention, a coil protector is provided for "C" hooks of the type described above to prevent damage to the edges of a coiled strip when the lower leg of the hook is inserted into the central opening of the coil.

Specifically, the protector of the invention comprises a face plate adapted to extend around the forward face of the vertical portion of the "C" hook and along its opposite side faces. Preferably, the face plate is approximately semicircular in cross section and can be formed by cutting a pipe in two along its central axis. The face plate is spaced from both the forward face and side faces of the vertical hook portion. A pair of mounting plates are secured to the inner surface of the face plate and are adapted to extend above the opposite side faces of the vertical hook portion; while means, preferably bolts extending through threaded openings in the mounting plates, secure the mounting plates and the face plate carried thereby to the vertical hook portion. On the forward face of the face plate is a cushioning or shock-absorbing material such as urethane.

With an attachment of this sort, it will be appreciated that as the lower leg of the "C" hook moves into the central opening of a coil, the shock-absorbing material on the face plate will engage the strip edges to prevent damage which was previously caused by slamming of the vertical portion of the hook into the side of the coil.

Figure 1:
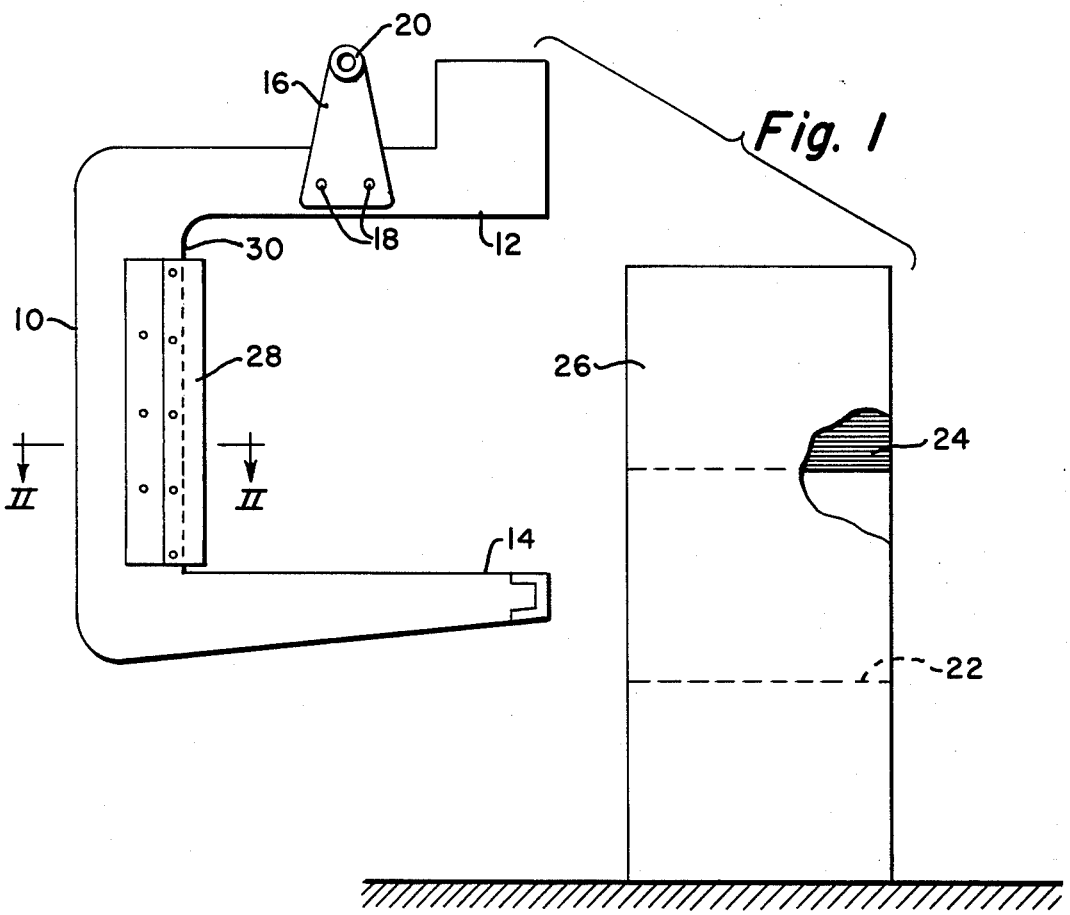
Figure 2:
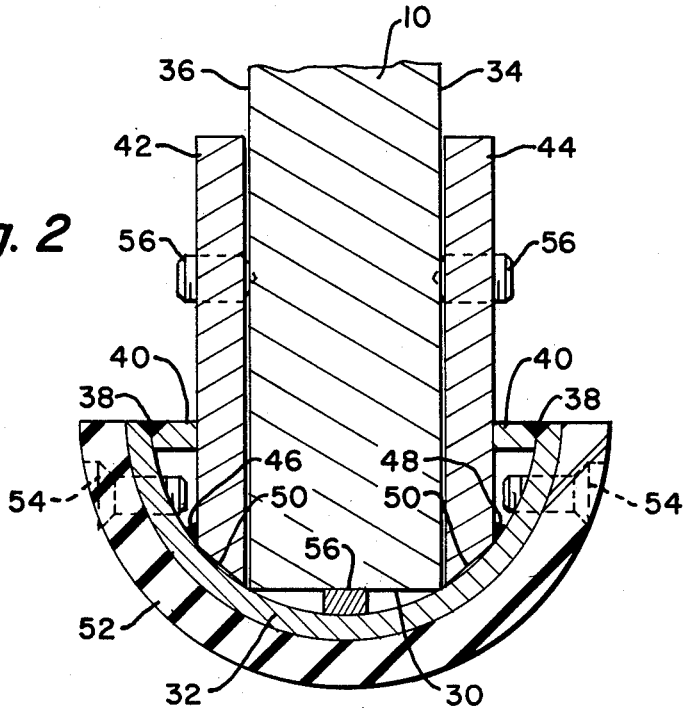

The above and other objects and features of the invention will become apparent from the following detailed description taken in connection with the accompanying drawings which form a part of this specification and in which:

FIG. 1 is a side view of a typical "C Hook" having the coil protector of the present invention attached thereto; and FIG. 2 is a cross sectional view taken substantially along line II—II of FIG. 1.

With reference now to the drawings, and particularly to FIG. 1, the "C" hook shown comprises a vertical portion 10 having a horizontal upper leg 12 and lower leg 14 projecting therefrom. A clevis 16 is secured to the upper leg 12 by means of bolts 18 or other fastening elements and is provided with an upper hinge pin 20 which is engaged by an overhead crane hook, not shown. Lower leg 14 is inserted into the central, circular opening 22 of coiled strip material 24, the arrangement being such that as the lower leg 14 is moved into the opening 22 and lifted upwardly by an overhead crane, the upper surface of the leg 14 will engage the periphery of the central opening 22 to lift the coil also. When the coil is deposited at another location within the mill, the foregoing process is reversed to remove the lower leg 14 from the opening 22.

As was explained above, it often happens that the vertical portion 10 of the "C" hook slams into the side 26 of the coiled strip material, thereby causing damage to the edges of the strip even though they might be perfectly aligned. In accordance with the present invention, a padded or cushioned coil protector 28 is secured to the vertical portion 10 such that it surrounds the forward edge 30 of the vertical portion 10. In this manner, any impact of the "C" hook against the side 26 of the coil will be cushioned by the coil protector 28.

The details of the coil protector 28 are shown in FIG. 2. It comprises a steel faceplate 32 which extends around the forward edge 30 of vertical portion 10 and along its side faces 34 and 36. In the embodiment of the invention shown in FIG. 2, face plate 32 is generally semi-circular in cross sectional configuration and can be formed by cutting a pipe along its longitudinal axis, for example. It should be understood, however, that the cross sectional configuration can be other than exactly semi-circular, the important point being that it cover the forward face 30 and vertical portion faces 34 and 36. The edges of the face plate 32 are welded at 38 to steel spacers 40 which, in turn, are welded at 41 to a pair of mounting plates 42 and 44 which extend along and substantially abut the side faces or surfaces 34 and 36 of vertical portion 10. Mounting plates 42 and 44 need not be in intimate contact with the side surfaces 34 and 36, but there should be a snug fit between the two. In the embodiment of the invention shown, the mounting plates 42 and 44 are also welded to the inner face of the face plate 32 at 46 and 48. In the embodiment of the invention shown, the forward edges 50 of the mounting plates 42 and 44 are bevelled as shown so as to approximately conform to the periphery of the face plate 32.

Covering the outer surface of the face plate 32 is a layer of cushioning or shock absorbing material 52 which is secured to the outer surface of the face plate 32 by means of screws 54 threaded into openings in the vertical edge portions of the face plate. The shock absorbing material 52 may, for example, comprise urethane having a thickness of about one half inch. A specific urethane which can be use is 90 Duramater Shore A (TM) urethane. The thickness of the urethane layer is not particularly critical.

In addition to the screws 54, the urethane is attached to the face plate 32 by vulcanizing or adhesive bonding. Holes are drilled and tapped along the length of the mounting plates 42 to receive hex head pointed screws as such screws 56. These are tightened against the side surfaces 34 and 36. The coil protector 28 will, of course, be secured to the vertical portion 10 of the "C-hook". The mounting plates 42 normally should not be welded to the vertical portion 10 since the hook is formed from heat treated T-1 steel; and heat from the welding operation may impair its strength. If desired, a spacer 58 may be welded to the central, interior face portion of the face plate 32 such that it is positioned between the inner-periphery of the face plate and the end 30 of vertical portion 10. Instead of using set screws, such as screws 56, it is also possible to provide threaded openings in the vertical portion 10 itself which would receive hex head bolts, for example, to secure the coil protector to the portion 10.

Although the invention has been shown in connection with a certain specific embodiment, it would be readily apparent to those skilled in the art that various changes in form and arrangement of parts be made to suit requirements without departing from the spirit and scope of the invention. In this respect, it will be appreciated that the coil protector can be mounted on other sections of the "C" hook for protection. The protector is light weight, designed for easy installation and removal, is simple to cover and recover with shock absorbing material, and is low in cost.

I claim as my invention:

1. An attachment for the vertical leg of a "C" hook to prevent damage to coiled strip as the lower leg of the hook is being inserted into the central opening of a coil; said attachment comprising a coil protector including a face plate adapted to cover by extending around the forward face of the vertical portion of the "C" hook and along its opposite side faces to protect the coil from slamming against the forward face and side faces of the hook, a pair of mounting plates secured to the inner surface of said face plate and adapted to substantially abut the opposite side faces of said vertical leg, and means on said mounting plates for releasably securing the mounting plates and the face plate carried thereby at a predetermined fixed position to said vertical leg.

2. The attachment of claim 1 including shock absorbing material secured to the outer surface of said face plate such that said shock absorbing material will engage the side of a coil into which the hook has been inserted.

3. The attachment of claim 1 wherein said face plate is generally semi-circular in cross-sectional configuration.

4. The attachment of claim 3 including spacers disposed between the vertical side edges of said face plate and said mounting plates and welded thereto.

5. The attachment of claim 1 wherein said securing means comprises pointed set screws threaded through said mounting plates.

* * * * *